US005261833A

United States Patent [19]

Pujol

[11] Patent Number: 5,261,833

[45] Date of Patent: Nov. 16, 1993

[54] LAMP BASE ASSEMBLY

[75] Inventor: Roger Pujol, Scarsdale, N.Y.

[73] Assignee: Altman Stage Lighting Co., Inc., Yonkers, N.Y.

[21] Appl. No.: 781,007

[22] Filed: Oct. 18, 1991

[51] Int. Cl.[5] ..... H01R 11/22

[52] U.S. Cl. ..... 439/268

[58] Field of Search ..... 439/142, 143, 145, 135, 439/819, 821, 822, 268, 270, 263, 265

[56] References Cited

U.S. PATENT DOCUMENTS 2,641,627 6/1953 Lewis ..... 439/143

3,853,376 12/1974 Marechal ..... 439/142

4,072,382 2/1978 Reschke ..... 439/143

FOREIGN PATENT DOCUMENTS 0141436 4/1935 Fed. Rep. of Germany ..... 439/143

*Primary Examiner*—Larry I. Schwartz

*Assistant Examiner*—Hien D. Vu

*Attorney, Agent, or Firm*—Lackenbach Siegel Marzullo and Aronson

[57] ABSTRACT

Base assembly for high voltage lamps and the like which includes a rotatable cover and spring loaded electrical contact elements to enabale easy insertion and withdrawal of electrically conductive prong shaped elements.

6 Claims, 4 Drawing Sheets

FIG.(6(B)

LAMP BASE ASSEMBLY

BACKGROUND OF THE INVENTION

The present invention relates to a base for high voltage electrical devices such as high voltage lamps used in a stage or theatrical environment.

Such lamps and high voltage devices are powered by up to several thousand volts and should have a base which provides secure holding and the necessary insulation between elements of opposite electrical potential and safe and convenient engagement and release of the electrically conductive prong elements. Since the high voltage lamps and other devices can reach very high temperatures during use, convenient release without injury to operating personnel is an important consideration as is the avoidance of lamp breakage.

Prior art base elements have addressed the above concerns but have not been completely successful, particularly with respect to safe and convenient removal of the lamp or other device from the base.

SUMMARY OF THE INVENTION

A base for a high voltage electrical device is provided which comprises a non-electrically conductive body member which has a planar upper surface, a bore type aperture which is perpendicular to the planar upper surface which defines a pivotal longitudinal axis of rotation. The body member also has a recess extending normal to a pivotal radius and is open at the planar upper surface.

A first electrical contact element is fixedly but removeably positioned in the recess and has an external groove parallel to the pivotal axis of rotation. A second electrical contact element is positioned in the recess, which may have an external groove parallel to the pivotal axis of rotation which is oppositely adjacent the groove of the first electrical contact element. An actuating extension element is provided extending between the second electrical contact member and a cover member to move the electrical contacts apart upon rotation of the cover member.

Deformable resilient means are provided in the recess forcing the second electrical element toward the first electrical contact to establish a longitudinally extending aperture defined by the one or more grooves and the resilient means compressibly holds in the aperture an electrically conductive prong element of a high voltage lamp or the like.

An electrically non-conductive cover means is slidably mounted on the planar upper surface of the body member and has a through bore which is in-line with the bore of the body member and has a recess opposite the planar upper surface of the body member to receive the extension element of the second electrical contact element. The recess of the cover member has an actuating member positioned therein for contacting the extension element upon rotation of the cover means.

Pivot means are provided which extend through the through bore of the cover means and into the bore of the body member for pivotal engagement of the cover means and with respect to the body member.

Upon application of pivotal rotational force to the cover means with respect to said body member, the actuating member in the recess in the cover member contacts the extension element of the second electrically conductive contact member and moves the second electrically conductive contact element away from the first electrically conductive contact element to permit a compressibly engaged electrical prong element, e.g. of a lamp, to be freely removed from the aperture formed by the oppositely adjacent grooves in the first and second electrically conductive contact elements. The resilient means in the recess is deformed by such movement of the second electrical contact element so that upon removal of pivotal rotational force from the cover member the second electrical contact element is caused to move toward the first electrical contact element to its initial position to enable compressible holding of an electrically conductive prong element therebetween.

BRIEF DESCRIPTIONS OF THE DRAWINGS

Figure 7:
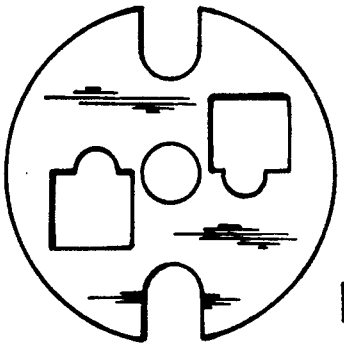
Figure 7A:
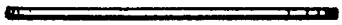

FIGS. 6(A)-(D) show the electrically conductive contact elements of the invention; and FIGS. 7, 7(A) show an insulation gasket for use with the present invention.

DETAILED DESCRIPTION OF THE INVENTION

Figure 1A:
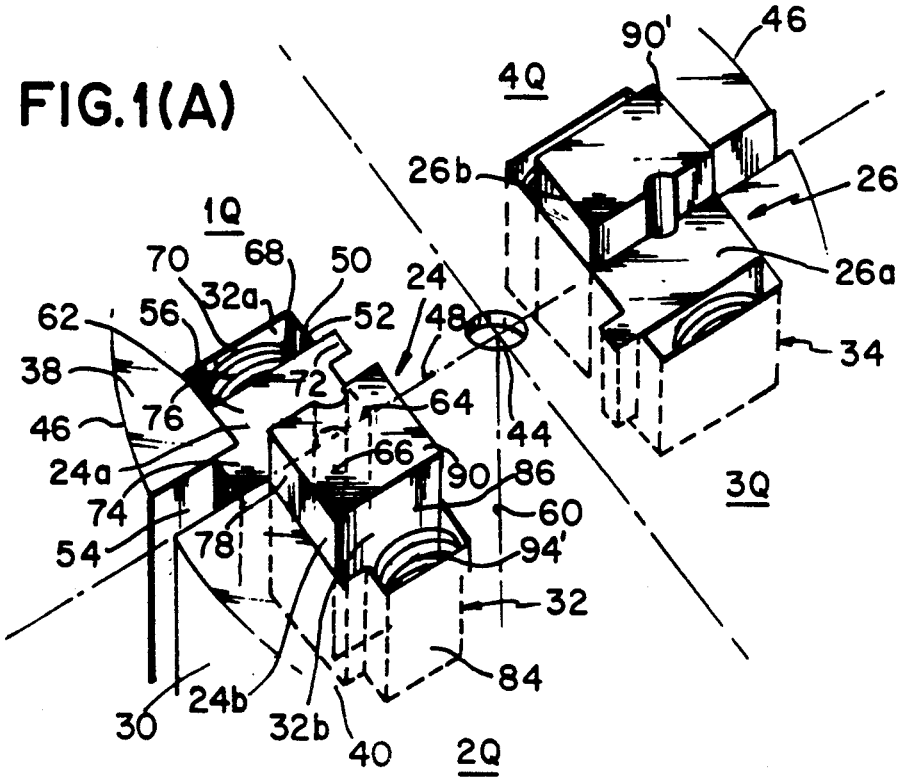
FIG. 1(A) is a partial perspective view of a portion of the device of FIG. 1.
Figure 1:
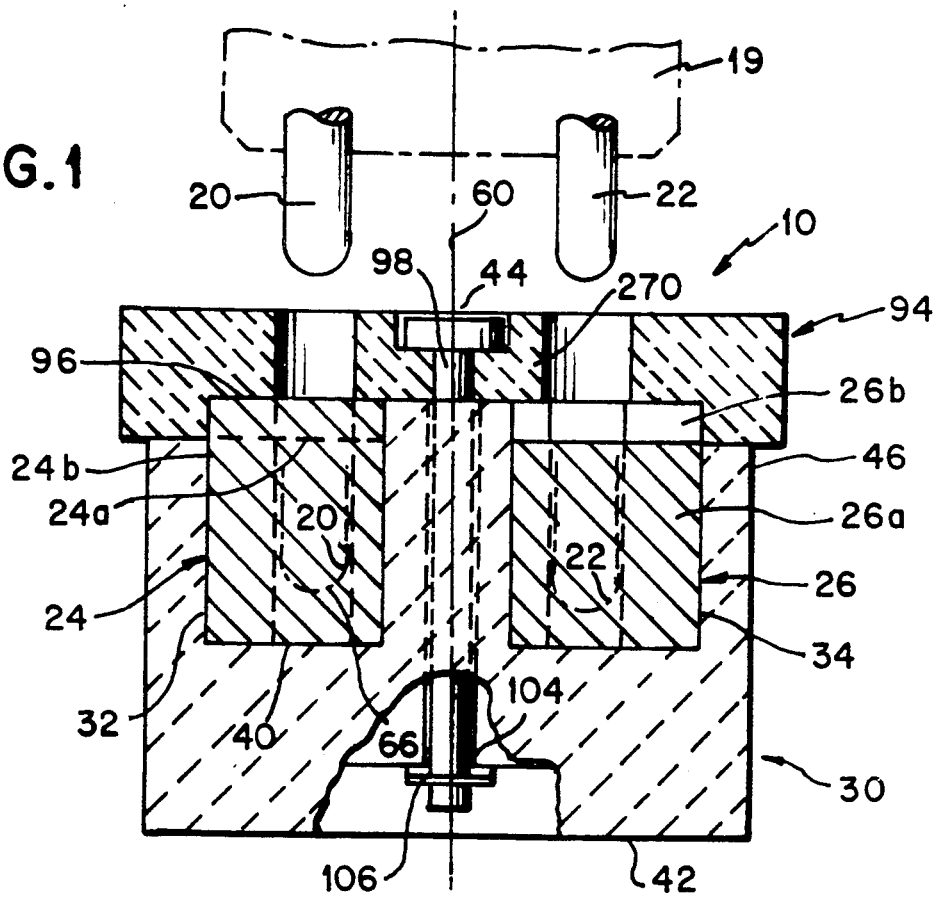
FIG. 1 is a front elevation view, partly in section, of the base assembly of the invention.
Figure 2:
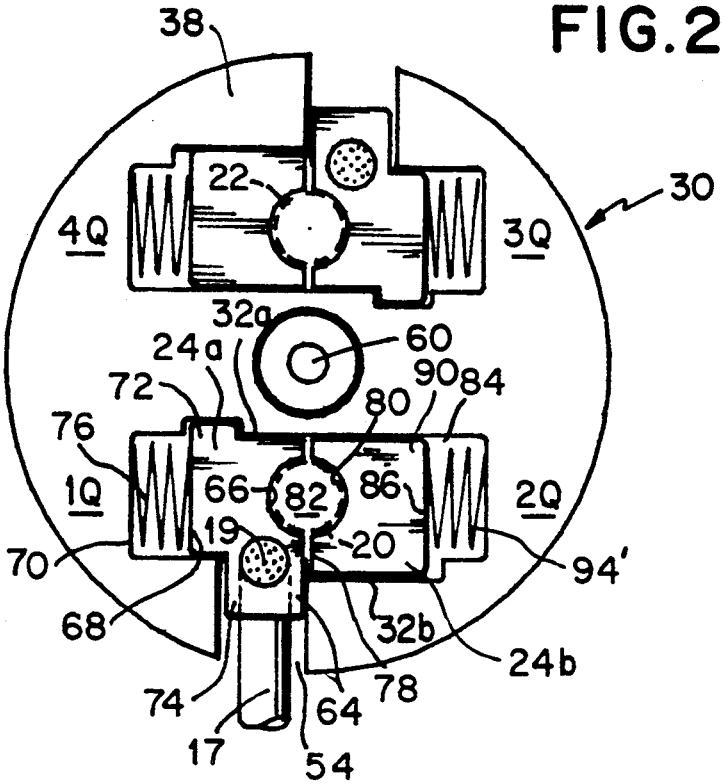
FIG. 2 is a plan view of the base member of the present invention.
Figure 5:
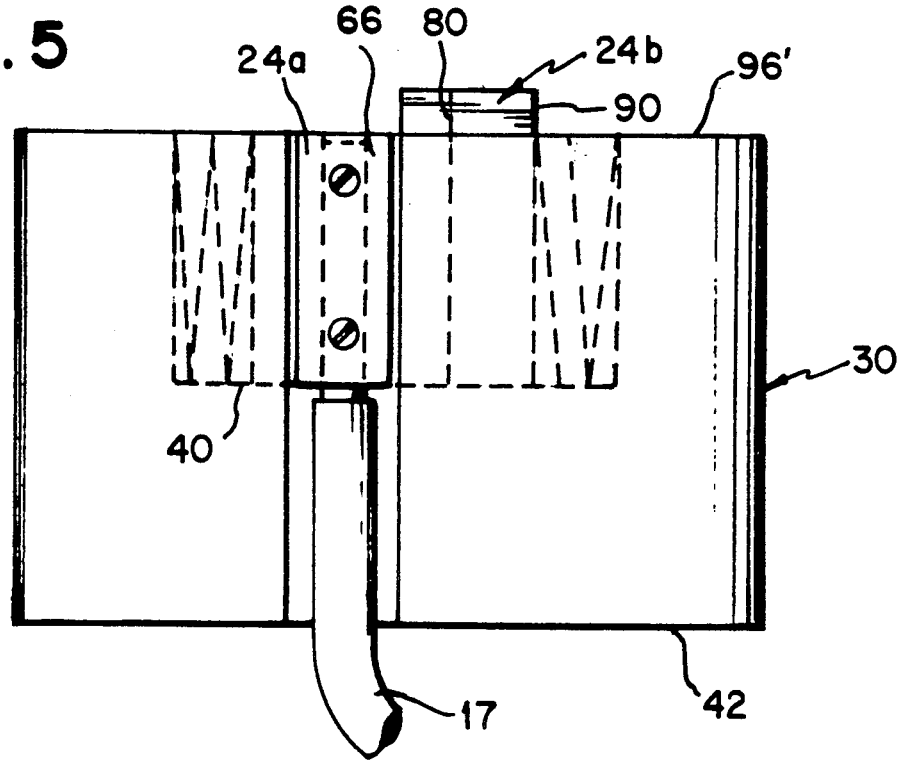
FIG. 5 is a side elevation view of the base member of the invention.
Figure 4:
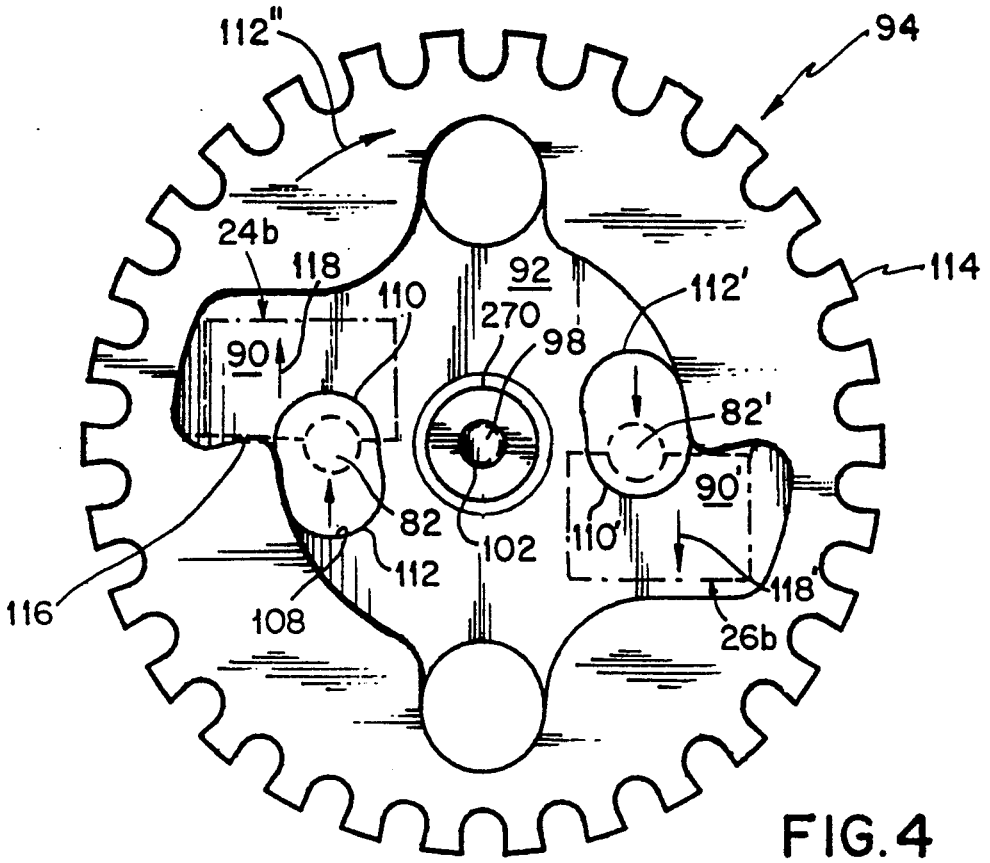
FIG. 4 is a view of the bottom of the cover member of FIG. 3.
Figure 3:
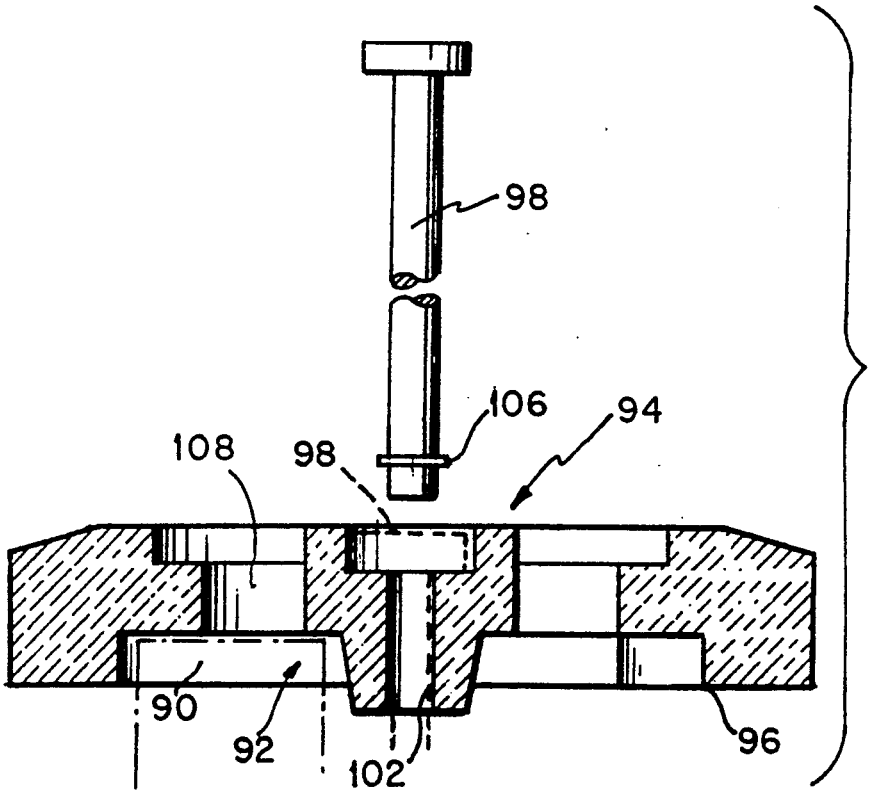
FIG. 3 is a side elevation view in section of the cover member of the device of FIG. 1.
Figure 6A:
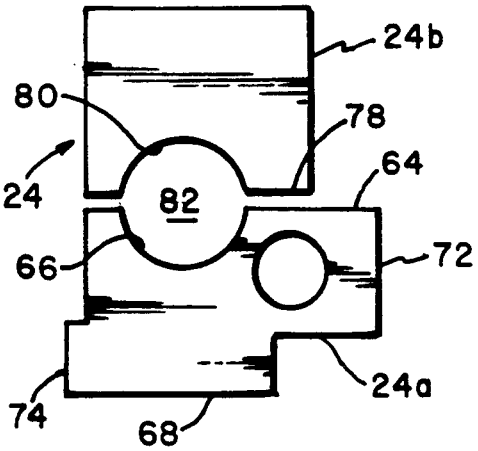
Figure 6C:
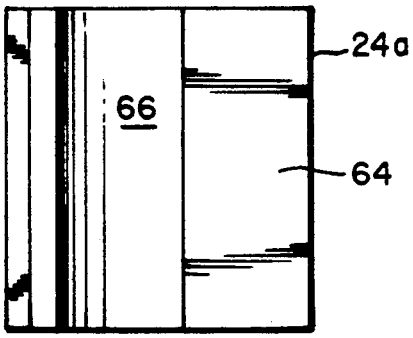
Figure 6D:
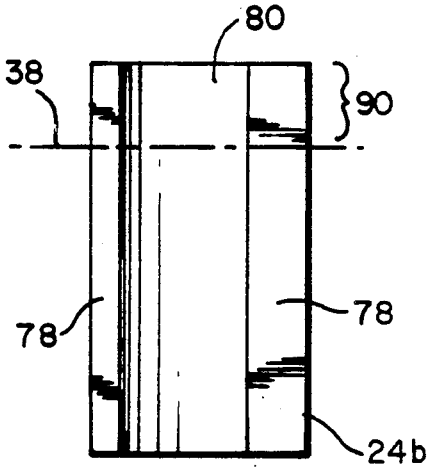
Figure 6D:
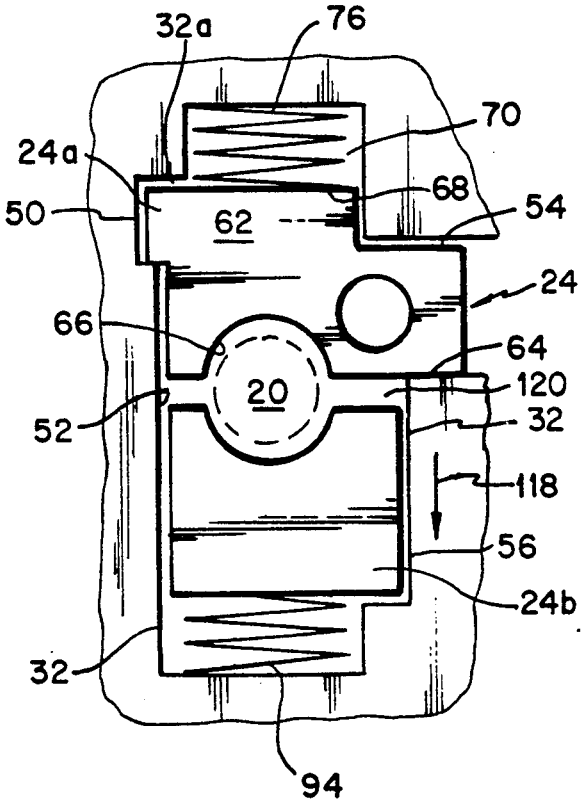

With reference to the drawings, FIG. 1 shows a lamp base or ceramic body 10 for receiving the electrically conductive prong terminals 20, 22 of a high voltage electrical device 19 such as a high voltage lamp bulb which is customarily powered by a source of up to several thousand volts applied to its terminals 20, 22 by way of electrically conductive contact members 24, 26 each comprising two elements 24*a*, 24*b* and 26*a*, 26*b* shown also in FIGS. 1(A) and 6(A)-(D). The contact members 24, 26 are positioned within an electrically non-conductive, i.e. ceramic or refractory material body member 30 in respecive recesses 32,34. Recess 32 extends from an opening 36 in the generally circular planar upper surface 38 of the body member 30 to a shelf-like support element 40 of body member 30.

Body member 30 has a generally cylindrical periphery. The support element or shelf 40 is intermediate the upper circular planar surface 38 and the bottom circular planar surface 42 of body member 30. The recess 32 is positioned between the center 44 of the upper surface 38 and the circumference 46 of the upper surface 38 of body member 30 and extends perpendicular to diameter 48 of the upper surface 38. Recess 32 bridges the first and second quadrants of the upper surface 38 indicated at 1Q and 2Q. As shown in FIG. 1(A) portions 32*a* of recess 32 extends into the quadrant 1Q, and the portion 32*b* extends into the second quadrant 2Q. A first key way slot 50 is provided in the inner side 52 of recess 32 and is located in the first quadrant 1Q. A second key way slot 54 is provided in the outer side 56 of recess 32. Both key way slots 50, 54 are located in the first quadrant, 1Q, and are parallel to the longitudinal axis 60 of the ceramic body 10. With reference to FIG. 1(A) and FIGS. 6(A)-(D), first electrically conductive element 24a of contact member 24 is seated in the first recess 32 in the portion 32a in the first quadrant 1Q. Element 24a has an upper surface 62 flush with upper surface 38 of ceramic body 10 and has a side 64 abutting the second quadrant, 2Q, which is provided with a semicircular groove 66 parallel to the longitudinal axis 60 of ceramic body 10. The opposite side 68 of electrically conductive element 24a defines a channel 70 in recess 32. The integral key member 72 slidably engages key way slot 50 and integral key member 74 slidably engages key way slot 54. A compressible resilient means, e.g. a spring 76 is placed, under compression, in channel 70 and firmly hold electrically conductive element 24a in a fixed position in recess 32 of ceramic body 10. a second electrically conductive element 24b is seated in the portion 32b of recess 32 in the second quadrant 2Q and has a side 78 oppositely adjacent the side 64 which has semicircular groove 66. Side 78 of the second electrically conductive element 24b also has a semicircular groove 80 positioned opposite to groove 66 and together the grooves 66, 80 establish a circular aperture 82 for receiving an electrically conductive prong terminal 20. Alternatively, a groove is provided in only one of the electrical contacts where the resulting aperture configuration is adequate and to receive and hold the prong terminal. A resilient compressible member 94', e.g. a spring member is placed under compression in channel 84 defined by side 86 of element 24b and recess 32.

Electrically conductive element 24b has a vertically extending integral element 90 extending above the upper surface 38 of ceramic body 10 and is received in recess 92 of removeable electrically non-conductive cover member 94 which is slidably seated at 96 on ceramic body upper surface 38 and pivotally secured to ceramic body 10 by pivot pin 98 which slidably engages passage 102 of cover member 94 and passage 104 of body member 30 and is secured in place by a suitable retaining clip 106. Alternatively, pivot pin 98 can be threaded, as can the interior passage 104, so that pivot pin 98 can be threadably engaged and fixed to body 30. Cover member 94 has an oblong shaped aperture 108 which extends through the cover member 94 and has a portion 110 which is in register with circular apertures 82 and 82' and an opposite portion 112 and 112' which is out of register with circular aperture 82. When it is desired to release terminals 20, 22 which are compressibly held in circular aperture 82 by elements 24a and 24b (which are spring loaded), cover member 94 is pivotally rotated a few degrees about pivot pin 98 in the direction indicated at 112", by hand turning cover member 94 which is provided with a knurled edge 114 to facilitate turning. When rotated in the direction 112", the actuating edge 116 of recess 92 contacts vertically extending portion 90 of element 24b which extends into recess 92. Further rotation of cover member 94 moves element 24b in the direction indicated at 118 and spring member 94' is compressibly shortened in channel 70 and the electrically conductive elements are separated as indicated at 120, and the prong terminal 20 can then be freely removed from the base member by simply lifting the device 19 from the ceramic body 10. Upon releasing cover member 94, spring member 94' expands to its initial length and returns element 24b to its initial position and circular aperture 82 is re-established and ready to compressibly engage an inserted prong terminal 20. The same operational and functional effect can be achieved by a reverse configuration wherein the electrically conductive contact members 24, 26 comprising element 24b has a recess instead of an extending element 90 and cover member 94 has an extending element instead of a recess 92.

The provision of an oblong through hole aperture 108 in cover member 94 with an out-of-register portion 108 eliminates the danger of "binding" prong terminal 20 when the cover member 94 is rotated in the direction 112"; "binding" would occur if only the in-register portion was present. High voltage power is provided to prong terminal 20 from conductor 19 which is coupled to element 24a at electrical device 19.

Recess 34 is symmetrical about longitudinal axis 60 with respect to recess 32 and is essentially identical thereto as are electrically conductive elements 26a and 26b of electrically conductive contact 26, and function in the same manner as elements 24a and 24b, and simultaneously therewith in the third and fourth quadrants 3Q, 4Q upon rotation of cover member 94 as above-described.

In the present invention any practical number of recesses and associated resilient members and electrically conductive contact elements can be incorporated in the body member. The preferred material for the electrically non-conductive body and cover member is ceramic, e.g. "Steatite" available from Wisconsin Porcelain Company, Sun Prairie, Wisconsin. The preferred material for the electrically conductive elements is copper. The resilient members are preferably high strength spring steel and resilient bands of steel can also be used. The gasket shown in FIG. 7, made of insulative material can be installed between the cover and body member to provide insurance against arcing in addition to that provided by the electrically non-conductive hub 270 of ceramic cover member.

What is claimed is:

1. Base assembly for a high voltage lamp electrical device comprising:

(a) a non-electrically conductive body member having a planar upper surface, a bore aperture perpendicular to said planar upper surface defining a pivotal longitudinal axis of rotation and at least one recess extending normal to a pivotal radius which is open at the planar upper surface;

(b) a first electrical contact element fixedly positioned in said at least one recess;

(c) a second electrical contact element positioned in said recess opposite said first electrical contact element, at least one of said first and second elements having an external groove parallel to said pivotal axis of rotation;

(d) deformable resilient means in said at least one recess forcing said second electrical element toward said opposite first electrical contact to establish a longitudinally extending aperture defined by said external groove for receiving and compressibly holding an electrically conductive prong element;

(e) electrically non-conductive cover means slidably mounted on the planar upper surface of said body member having a through bore in-line with said bore aperture of the body member; and (f) an actuating member for engaging the second electrical element with the cover means upon rotation of said cover means;

(g) pivot means extending through said through bore in-line of the cover means and into the bore aperture of the body member for pivotal engagement of the cover means with respect to the body member whereby upon application of pivotal rotational force to said cover means with respect to said body member the actuating member moves said second electrical contact member away from the first electrical contact member to permit an electrical prong element to be freely removed from said aperture, said resilient means being deformed by such movement of said second electrical contact element so that upon removal of pivotal rotational force from said cover member the second electrical contact element is caused to move toward said electrically contact element to enable compressible holding of an electrically conductive prong element therebetween.

2. Base assembly in accordance with claim 1 wherein the first electrical contact element has an upper surface which is even with the upper surface of the body memner.

3. Base assembly in accordance with claim 1 wherein additional resilient means are provided in contact with said first electrical contact element to secure said element in said recess of the body member.

4. Base assembly in accordance with claim 1 wherein said body member and cover are made of electrically non-conductive refractory or ceramic.

5. Base assembly in accordance with claim 1 wherein a semicircular groove is provided in the first electrical contact element and an opposing semicircular groove is provided in the second electrical contact; said grooves being semicircular in shape and the aperture between the first and second electrical contact elements being circular.

6. Base assembly for a high voltage lamp electrical device comprising:

(a) an electrically non-conductive body member having a planar upper surface, a bore aperture perpendicular to said planar upper surface defining a pivotal longitudinal axis of rotation and at least one recess extending normal to a pivotal radius which is open at the planar upper surface;

(b) a first electrical contact element fixedly positioned in said at least one recess having an external groove parallel to said pivotal axis of rotation;

(c) a second electrical contact element positioned in said recess having an external groove parallel to said pivotal axis of rotation and oppositely adjacent the groove of said first electrical contact element and having an extension element extending above said planar upper surface of said body member;

(d) deformable resilient means in said at least one recess forcing said second electrical element toward said first electrical contact to establish a longitudinally extending aperature defined by said oppositely adjacent grooves for receiving and compressibly holding an electrically conductive prong element;

(e) electrically non-conductive cover means slidably mounted on the planar upper surface of said body member having a through bore in-line with said bore aperture of the body member and having a cover means recess to receive the extension element of said second electrical contact means and having an actuating member in said cover means recess for contacting said extension element upon rotation of said cover means;

(f) pivot means extending through said through bore in-line of the cover means and into the bore aperture of the body member for pivotal engagement of the cover means with respect to the body member whereby upon application of pivotal rotational force to said cover means with respect to said body member the actuating member in said cover means recess contacts said extension element of said second electrical contact member and moves said second electrical contact member away from the first electrical contact member to permit an electrical prong element to be freely removed from said aperture formed by the semicircular grooves in said first and second electrical contact elements, said resilient means being deformed by such movement of said second electrical contact element so that upon removal of pivotal rotational force from said cover member the second electrical contact element is caused to move toward said first electrical contact to enable compressible holding of an electrically conductive prong element therebetween.

* * * * *